US007867146B2

(12) United States Patent
Ge et al.

(10) Patent No.: US 7,867,146 B2
(45) Date of Patent: Jan. 11, 2011

(54) HORSE-RIDING SIMULATING PHYSICAL FITNESS DEVICE

(75) Inventors: Sheng-Huang Ge, Xiamen (CN); Yan-Wei Hou, Xiamen (CN); Jin-Sheng Yu, Xiamen (CN)

(73) Assignee: Bob Hsiung, Taipei (TW)

( * ) Notice: Subject to any disclaimer, the term of this patent is extended or adjusted under 35 U.S.C. 154(b) by 0 days.

(21) Appl. No.: 12/712,198

(22) Filed: Feb. 25, 2010

(65) Prior Publication Data

US 2010/0248902 A1 Sep. 30, 2010

(30) Foreign Application Priority Data

Mar. 31, 2009 (CN) ..... 2009 2 0137426 U

(51) Int. Cl.
*A63B 22/00* (2006.01)

(52) U.S. Cl. ..... 482/51; 482/62; 472/95

(58) Field of Classification Search ..... 482/51, 482/52, 57, 62, 63, 64, 65, 72, 77, 95, 96, 482/110; 472/95, 97; 434/247; 601/36
See application file for complete search history.

(56) References Cited

U.S. PATENT DOCUMENTS 2,278,861 A * 4/1942 Burke ..... 74/40
4,586,706 A * 5/1986 Chen ..... 482/62
5,156,650 A * 10/1992 Bals ..... 482/57
5,299,997 A * 4/1994 Chen ..... 482/96
5,366,428 A * 11/1994 Liao ..... 482/96
5,453,066 A * 9/1995 Richter, Jr. ..... 482/96
5,549,527 A * 8/1996 Yu ..... 482/57
5,643,145 A * 7/1997 Lo et al. ..... 482/57
7,097,596 B2 * 8/2006 Yang ..... 482/57
7,427,256 B2 * 9/2008 Fan ..... 482/64
2004/0259694 A1 * 12/2004 Yang ..... 482/63
2010/0130331 A1 * 5/2010 Hu ..... 482/57

* cited by examiner

*Primary Examiner*—Loan Thanh
*Assistant Examiner*—Tam Nguyen
(74) *Attorney, Agent, or Firm*—Leong C. Lei

(57) ABSTRACT

A horse-riding simulating physical fitness device includes a bottom rack and a movable frame. The bottom rack includes a base positionable on ground and forms a front support that is rotatably coupled to a movable frame with a connection link and a rear support that is rotatably coupled to two crank arms extending in the same direction. The two crank arms are rotatably coupled to the movable frame with two rocker arms. The movable frame includes a seat bar and a head bar respectively supporting a seat cushion and a handlebar. When a user rides on the movable frame, using feet to tread the crank arms, the movable frame is caused to swing frontward and rearward along a predetermined motion trace to generate a horse riding like motion. Thus, a new style of exercise is provided, which offers versatile effects of training.

8 Claims, 8 Drawing Sheets

HORSE-RIDING SIMULATING PHYSICAL FITNESS DEVICE

(a) TECHNICAL FIELD OF THE INVENTION

The present invention generally relates to a physical fitness device that provides effect of training and exercise, and more particularly to a horse-riding simulating physical fitness device that offers versatile effects of training and provides a new style of exercise for increasing the desire of purchase of general consumers.

(b) DESCRIPTION OF THE PRIOR ART

With the development of the modern society, most people is undertaking insufficient amount of exercise, which is subjected to adverse constraint of space and sites for taking exercise. This eventually affects the physical strength and health of human beings. According to medical researches, taking exercise in less amount but more times is of the same effect of preventing heart disease as taking exercise in an intense manner for a long period of time. Thus, various physical fitness devices, which are usually very compact and occupy a small amount of storage space, are available in the market to allow a user to do exercise at home in any time for training muscles, joints, and strengths of various portions of his or her body, thereby eventually improving the health of the user.

Physical fitness devices that are operated by foot treading include an exercise bike, a treadmill, a climber, an elliptical trainer, and a stepping machine. All these physical fitness devices are operated by alternate movement of the feet of the user. Taking an exercise bike as an example, the conventional exercise bike comprises a frame positionable on the ground. The frame supports thereon a handlebar and a seat cushion. The frame also supports a drive wheel and a flywheel driven by the drive wheel. On opposite sides of the drive wheel, crank arms are provided to extend in opposite directions. To operate, a user sits on the seat cushion and uses his or her feet to alternately tread down the crank aims, which cause the drive wheel to drive the rotation of the flywheel, so as to realize training of muscles of feet. However, such a known exercise bike comprises a handlebar and a seat cushion that are fixed. Thus, no effect of training can be made on the upper portion of the user's body during the process of exercise. Further, the known exercise device offers styles of exercise that have been long and well known to the general consumer so that the intention of purchase of the general consumers for such known exercise devices is getting lowered and they cannot effectively attract the attention of the general consumers. It is also not possible for such known devices to enhance the interesting of the users to use such devices. In other words, a physical fitness device that provides a new style of exercise and versatile effects of training is desired to overcome such problems and to suit practical needs of physical fitness for general users.

SUMMARY OF THE INVENTION

Thus, a primary objective of the present invention is to provide a physical fitness device that simulates the motion of horse riding so as to provide a new style of exercise by which the attention of users can be attracted and the interesting of doing exercise of the users can be improved.

Another objective of the present invention is to provide a physical fitness device that simulates the motion of horse riding, by which versatile effect of training can be obtained and which is applicable to various portion of human body to enhance the result of exercise.

The above objectives are realized through the following technical solution, of which a physical fitness device is provided, comprising the following components:

A bottom rack comprises a base positionable on ground. The base comprises, in sequence from a front side to a rear side, a front support and a rear support mounted to a top thereof. The rear support comprises two side boards respectively and rotatably coupled to two crank arms that extend in the same direction. The two crank arms respectively comprise two rocker arms fixed thereto and located inside the two side boards of the rear support and extending in the same direction. One of the crank anus is provided with a drive wheel outside the rear support for simultaneous rotation in unison therewith. The base comprises a wheel support mounted thereto. The wheel support rotatably supports a flywheel. The drive wheel drives the flywheel to simultaneously rotate in unison therewith through a transmission assembly. The front support has an upper end rotatably coupled to a connection link.

A movable frame comprises a connection bar having opposite ends respectively coupled to the rocker arms of the bottom rack and the connection link. The connection bar comprises a seat bar that is set close to the rocker arms and supports a seat cushion. The movable frame comprises a head bar, which has an upper end to which a handlebar is mounted.

As such, with the arrangement provided by the previously discussed technical solution, the physical fitness device of the present invention allows a user to ride on the movable frame with feet treading on the crank arms to drive the movable from to swing frontward and rearward along a predetermined motion trace thereby generating a horse riding like movement, which provides a new style of exercise and realizes versatile effects of training and physical fitness, thereby enhancing the intention of a user to take exercise with such a device. The present invention offers advantages over the know fitness equipment in respect of versatility of training, effectiveness of training and style of exercise.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
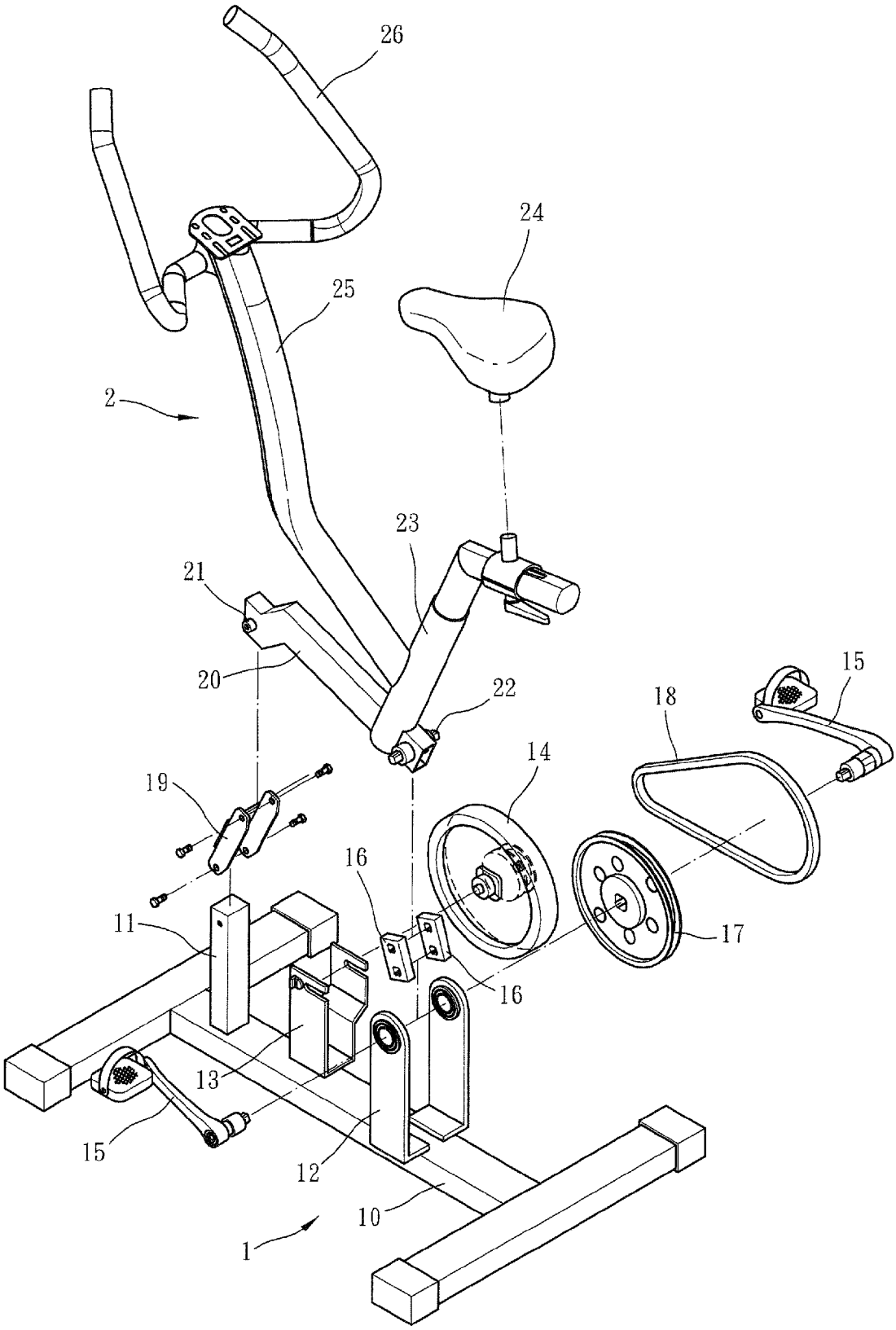
FIG. 1 is an exploded view of a physical fitness device according to the present invention, showing various components of the physical fitness device.
Figure 2:
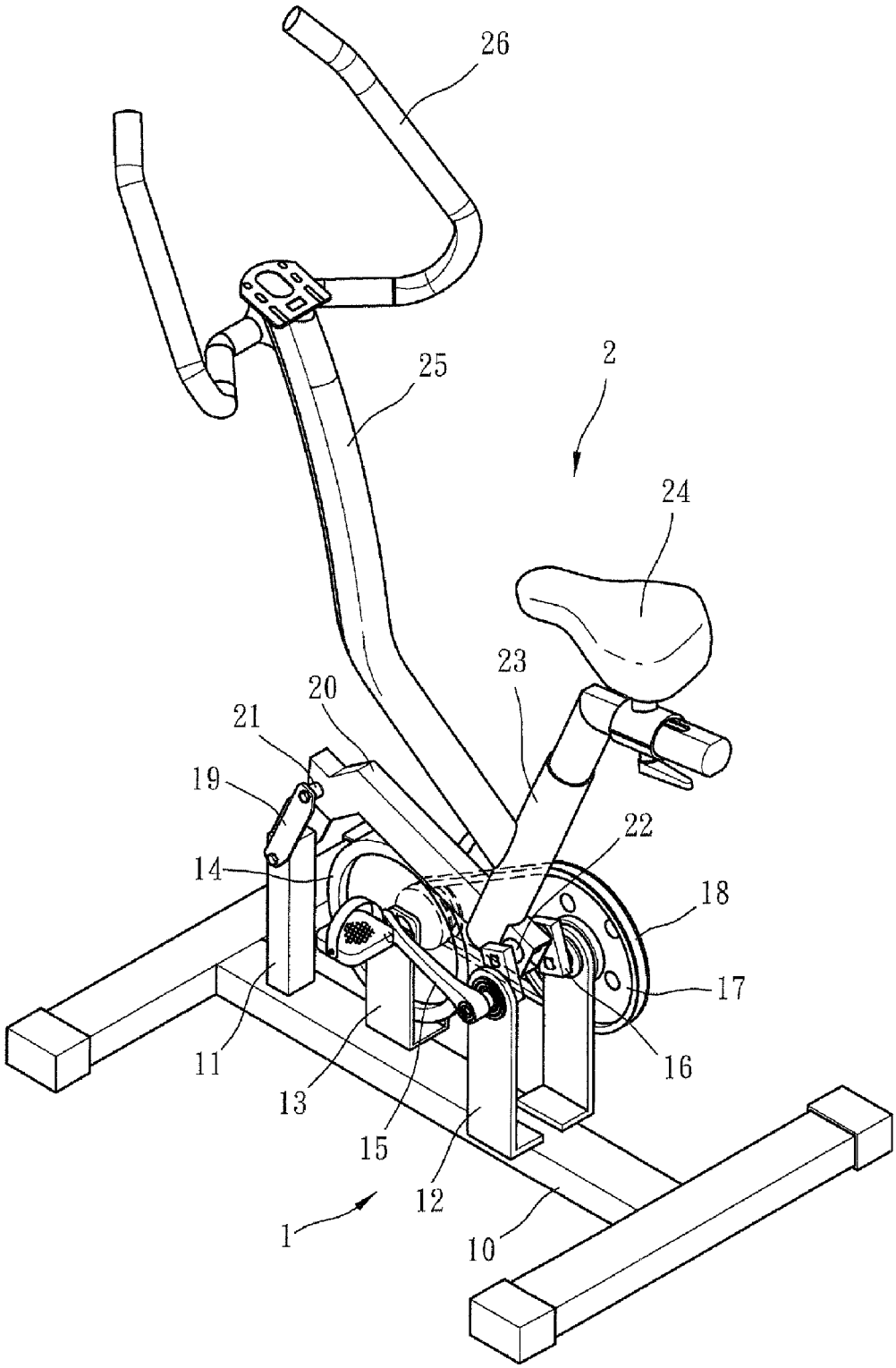
FIG. 2 is a perspective view of the physical fitness device according to the present invention in an assembled form.
Figure 3:
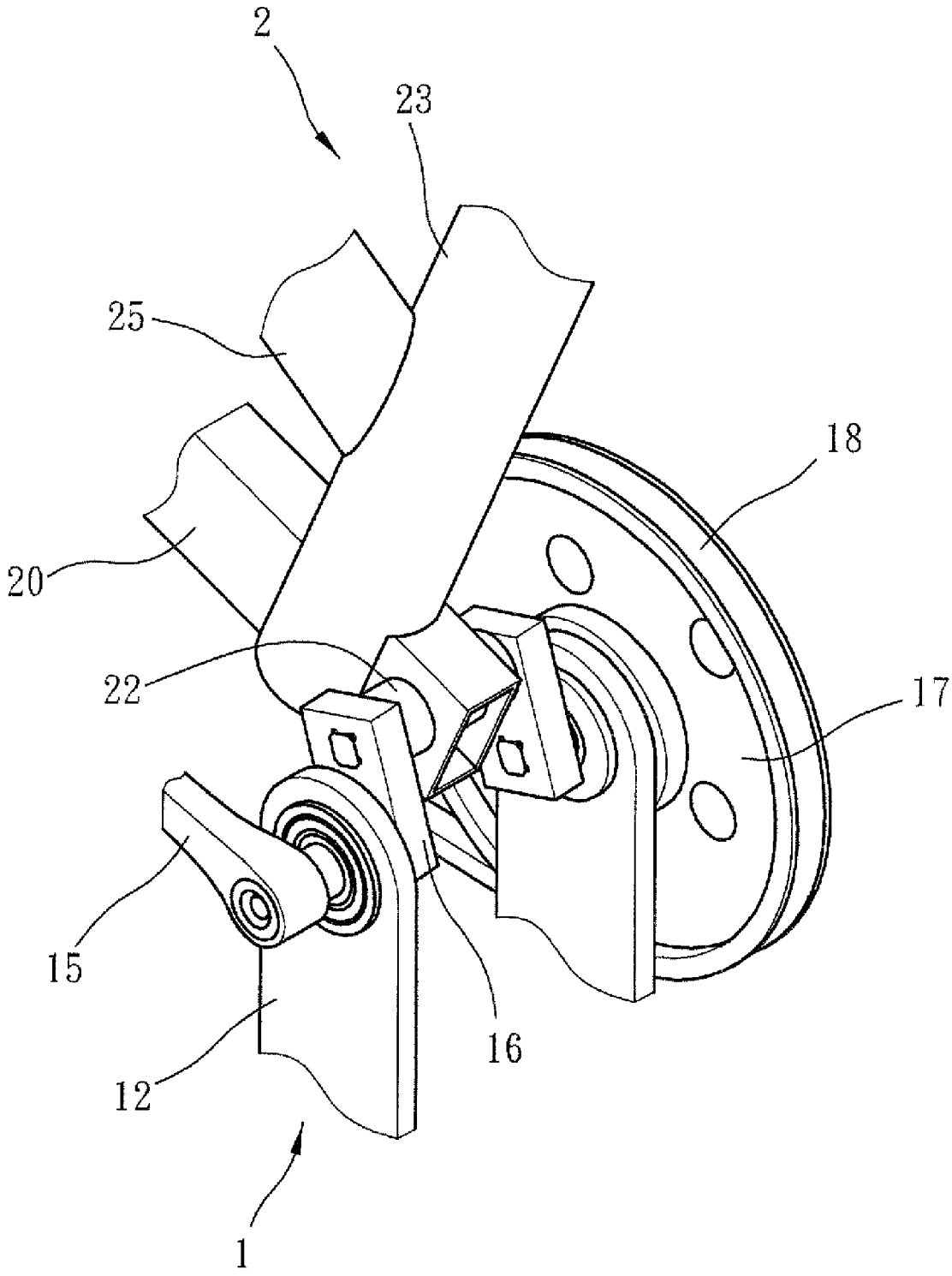
FIG. 3 is an enlarged view of a portion of the physical fitness device according to the present invention illustrating the connection for driving.
Figure 4:
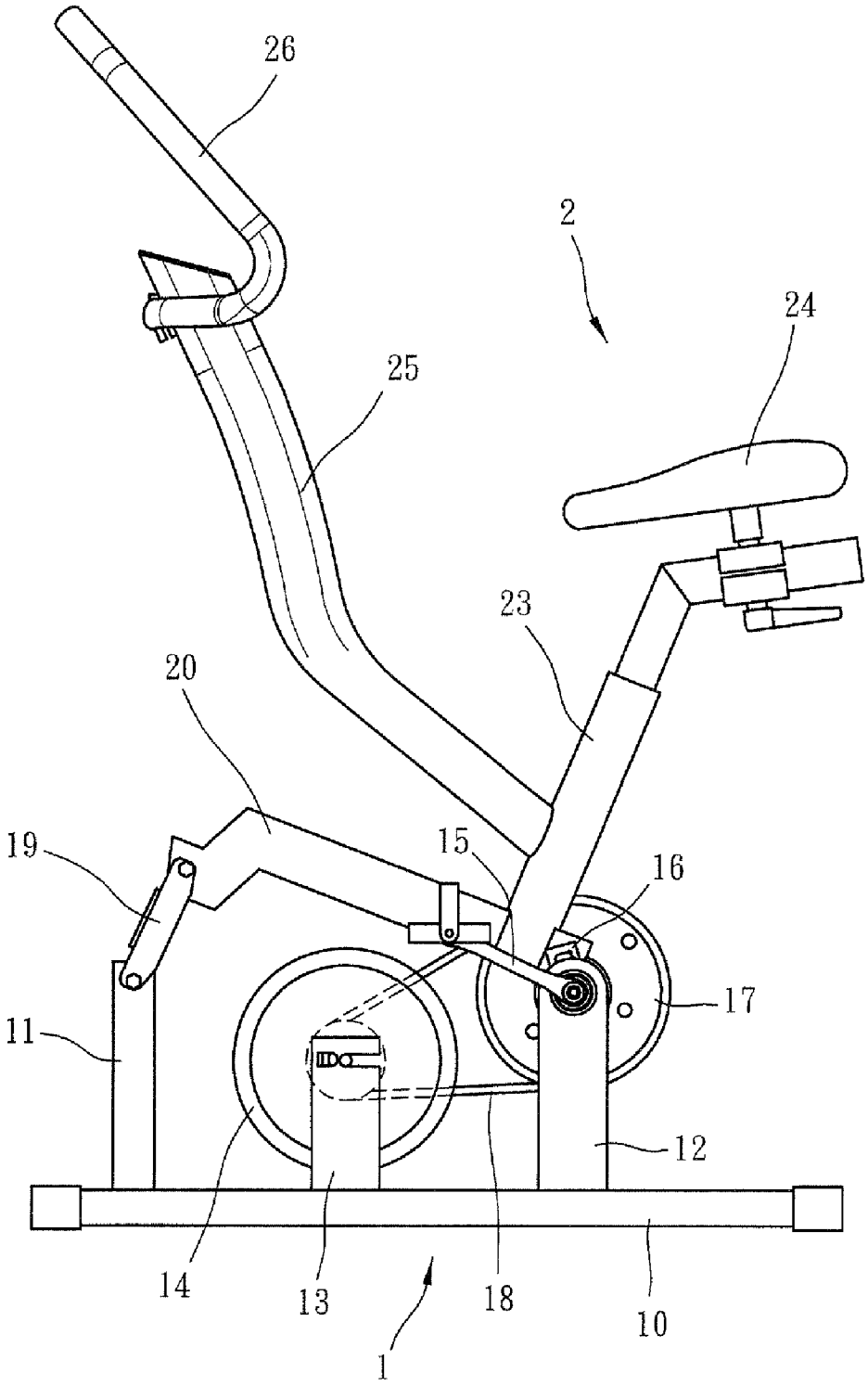
FIG. 4 is a side elevational view of the physical fitness device according to the present invention in the assembled form.

The present invention provides a physical fitness device, of which an exploded view is shown in FIG. 1 of the attached drawings. As shown, the physical fitness device comprises a bottom rack 1 that is positionable on a fixture surface, such as ground, and a movable frame 2 arranged on the bottom rack 1, whereby the movable frame 2 is movable frontward and rearward on the bottom rack 1 by following a predetermined movement trace to generate a horse riding like motion.

Details of a preferred embodiment of the present invention will be described with reference to FIGS. 1-4. The bottom rack 1 comprises a base 10 having an I-shape. Mounted on a top of the base 10 are, sequentially from a front side to a rear side, a front support 11 in the form of an erected bar, a U-shaped frame like wheel support 13, and a U-shaped frame like rear support 12. The wheel support 13 rotatably receives and supports therein a flywheel 14, which allows for adjustment of damping resistance thereof (not illustrated in the drawings). The rear support 12 has two spaced side boards, which are respectively and rotatably coupled to two crank arms 15 that extend in the same direction, whereby the two crank arms 15 are simultaneously rotatable in the same rotational direction. The two crank arms 15 are respectively provided with rocker arms 16 fixed thereto. The rocker arms 16 are respectively located inside the two side boards of the rear support 12 to extend in the same direction (see FIG. 3). The rocker arms 16 are set at a predetermined included angle with respect to the crank arms 15. The crank arms 15 drive the rocker arms 16 to simultaneously rotate in unison therewith. An end of each rocker arm 16, which is opposite to the respective crank arm 15, is coupled to a rear end portion of the movable frame 2. One of the crank arms 15 is provided with a drive wheel 17 outside the rear support 12 for simultaneous rotation in unison therewith. The drive wheel 17 drives simultaneous rotation of the flywheel 14 through a transmission assembly 18, which can be for example a belt, a chain, or mated gears. Further, the front support 11 has an upper end rotatably coupled to a connection link 19 of which an opposite end is rotatably coupled to a front end portion of the movable frame 2.

The movable frame 2 comprises a connection bar 20, which has a front end comprising a first pivot 21 coupled to the connection link 19 and a rear end comprising a second pivot 22 coupled to the rocker arm 16. Further, the connection bar 20 comprises a seat bar 23 formed thereon close to the second pivot 22 on the rear side thereof. The seat bar 23 is provided, on an upper end thereof, with a seat cushion 24 to allow a user to sit thereon. The movable frame 2 also comprises a head bar 25 that extends upwards at the side opposite to the seat bar 23. The head bar 25 has an upper end supporting a handlebar 26 to be held by a user.

As such, with a user sitting on the movable frame 2 and treading the two crank arms 15, the rocker arms 16 drive the movable frame 2 to swing frontward and rearward on the front and rear supports 11, 12 to thereby provide a horse-riding simulating physical fitness device that offers a new style of exercise and generates effects of versatile training operation.

Figure 5:
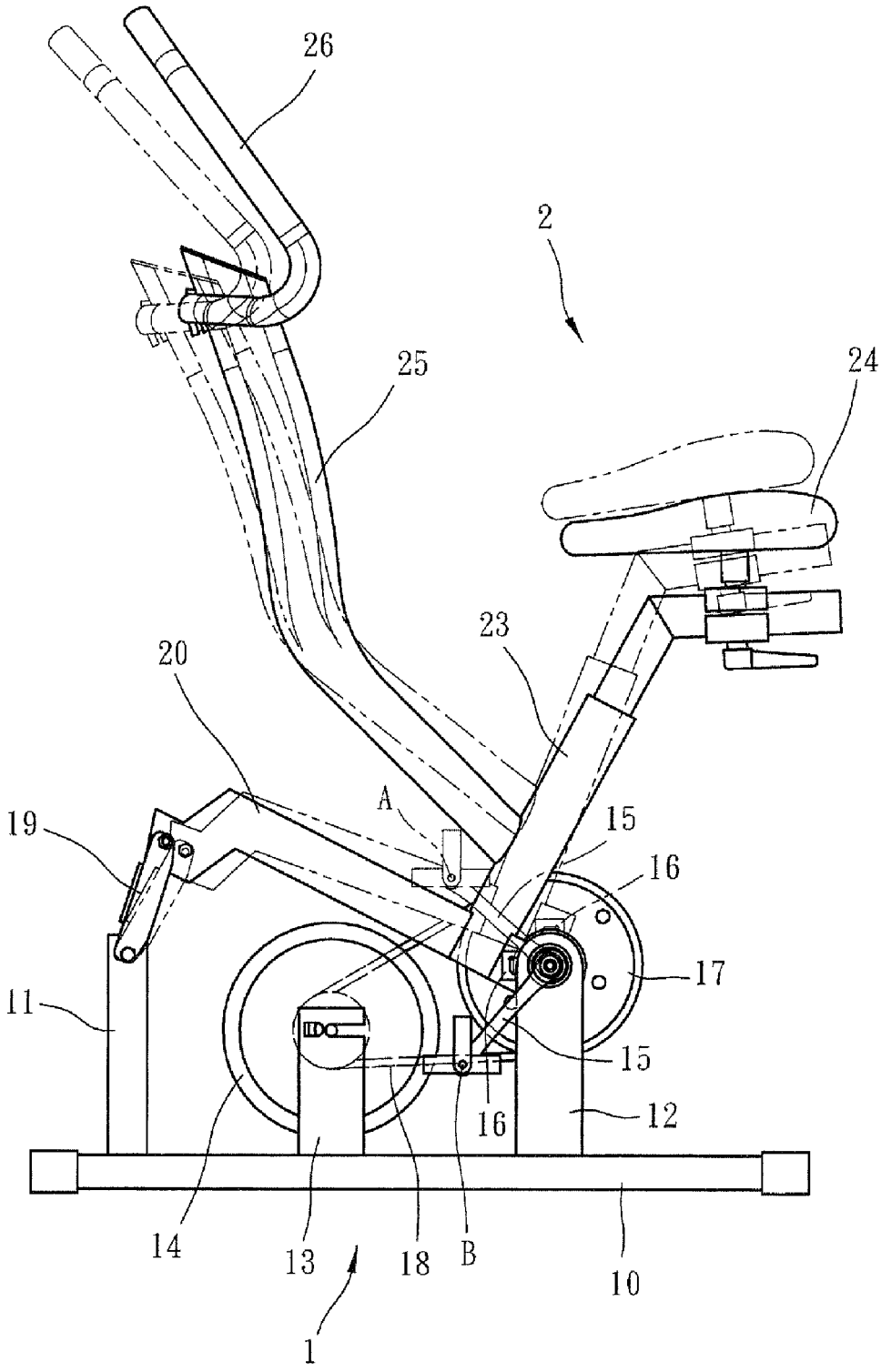
FIG. 5 is a schematic view illustrating a first phase of the operation of the physical fitness device of the present invention, wherein crank arms move from point A to point B.
Figure 6:
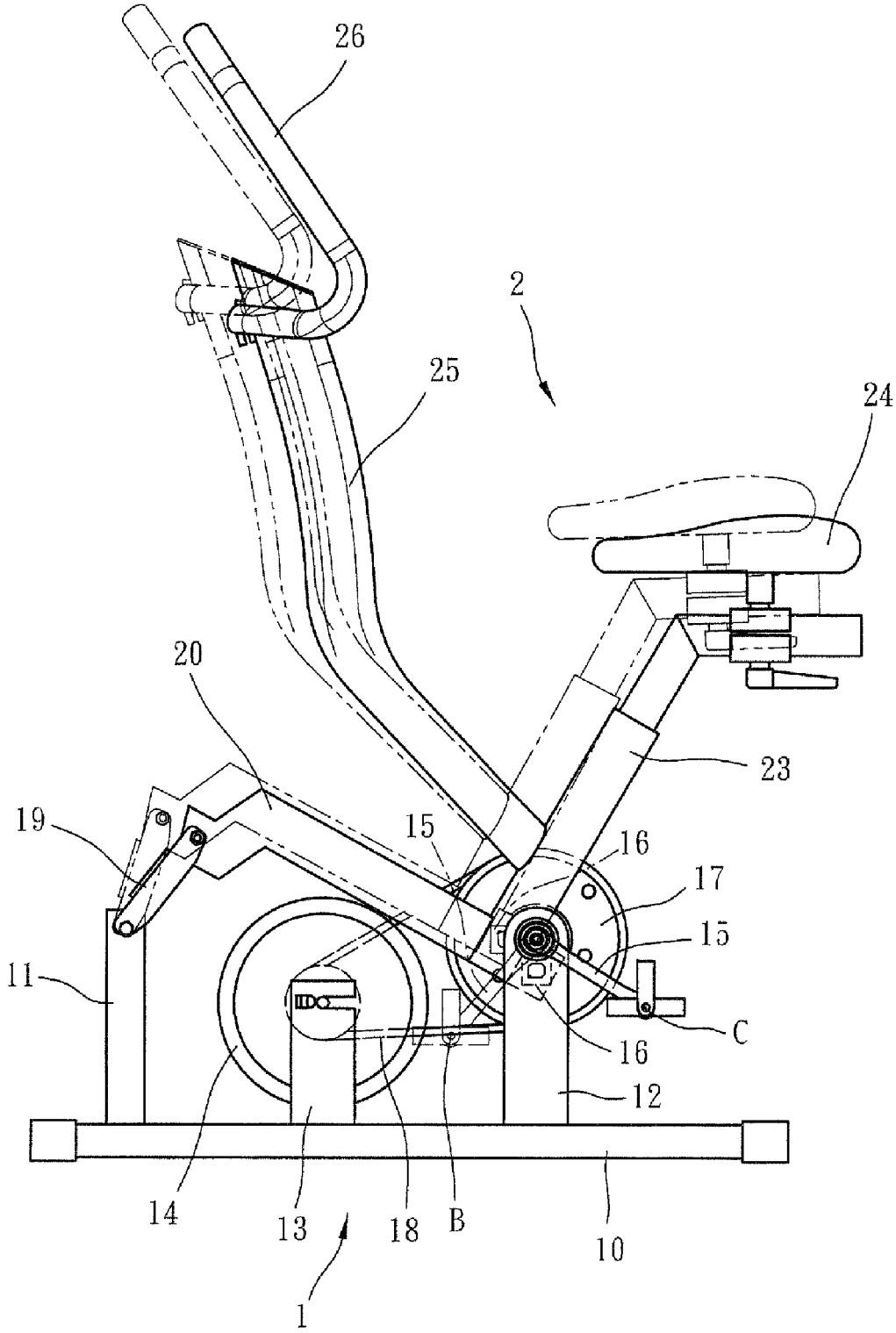
FIG. 6 is a schematic view illustrating a second phase of the operation of the physical fitness device of the present invention, wherein the crank arms move from point B to point C.
Figure 7:
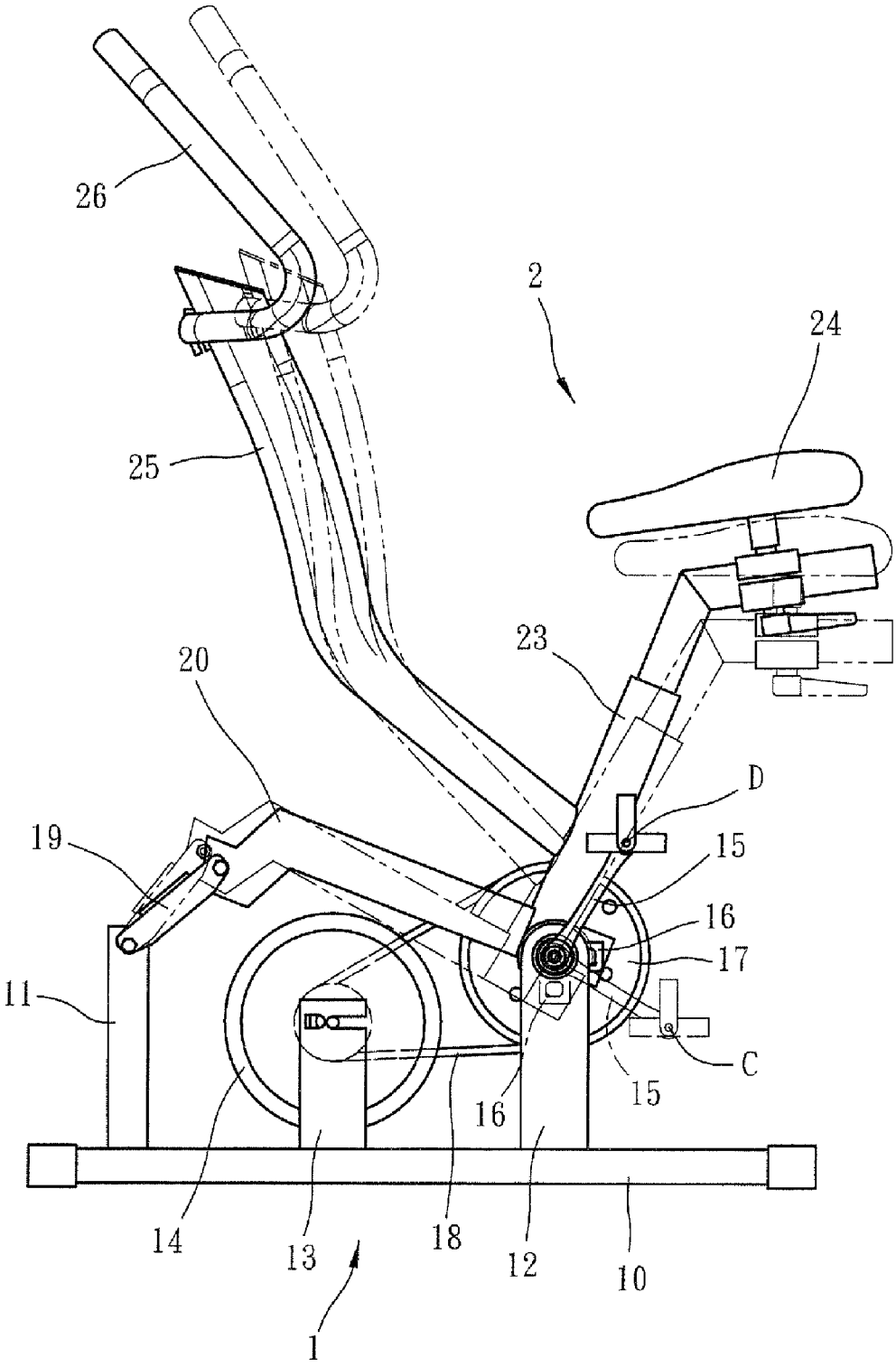
FIG. 7 is a schematic view illustrating a third phase of the operation of the physical fitness device of the present invention, wherein the crank arms move from point C to point D.
Figure 8:
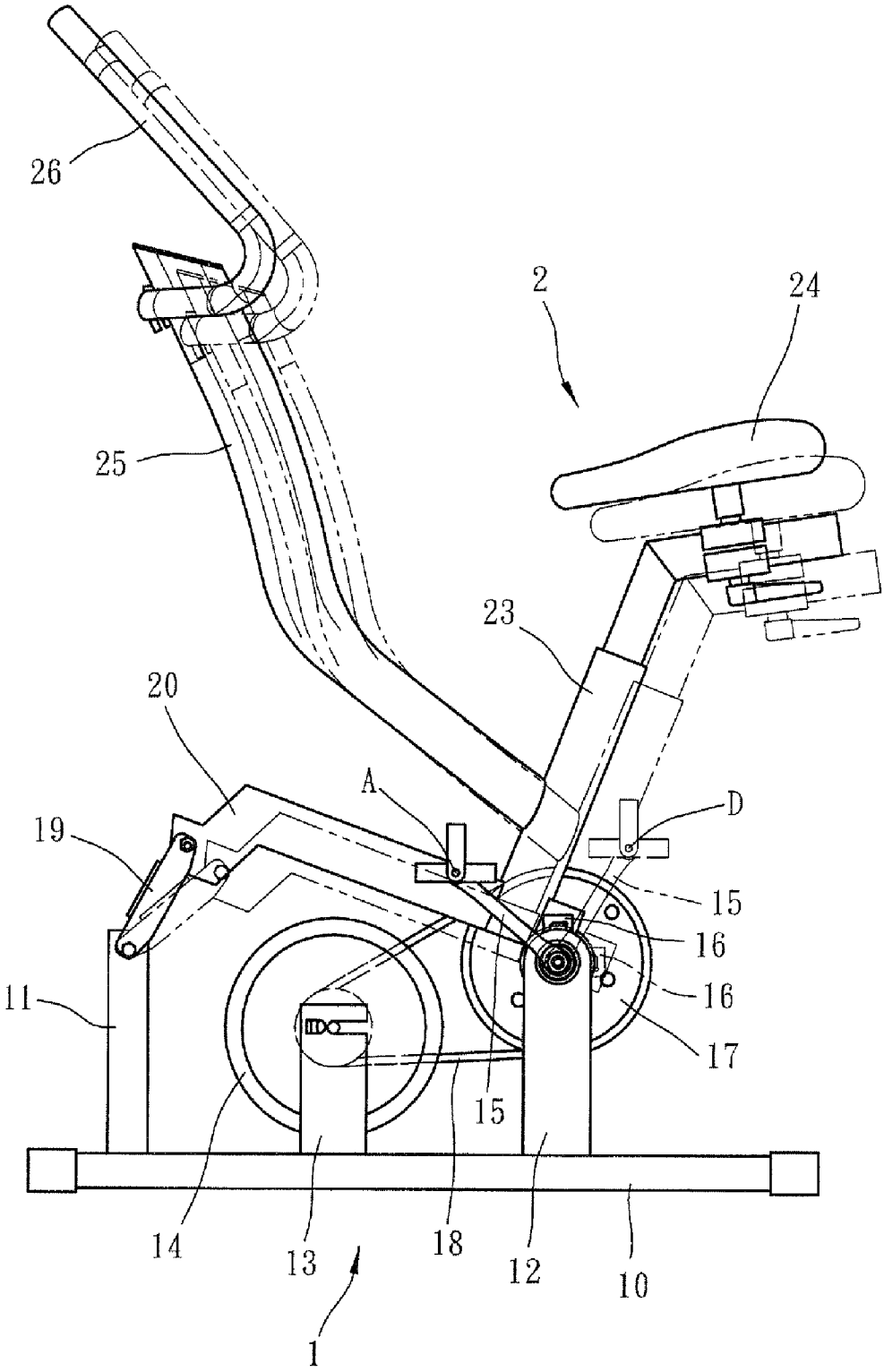
FIG. 8 is a schematic view illustrating a fourth phase of the operation of the physical fitness device of the present invention, wherein the crank arms move from point D back to point A.

In a practical operation of the physical fitness device of the present invention, as shown in FIGS. 5-8, a user sits on the seat cushion 24 of the movable frame 2 and uses the feet to tread the two crank arms 15, with hands holding the handlebar 26 of the movable frame 2. Synchronous treading motions effected by the feet cause the crank arms 15 to rotate in the same direction, so that the two crank arms 15 move from point A to point B (as shown in FIG. 5), meanwhile the rocker arms 16 are caused from a highest point to gradually descend to a lower point, making the movable frame 2 swinging rearward and downward. With further and synchronous treading of the crank arms 15 by the feet, the two crank arms 15 are caused to move from point B to point C (as shown in FIG. 6), causing the rocker arms 16 to reach a lowest point and making the movable frame 2 to further swing rearward and downward. Afterward, with the feet further treading the crank arms 15 to continuously rotate in the same direction, the two crank arms 15 are caused to move from point C to point D (as shown in FIG. 7), causing the rocker arms 16 to gradually ascent and making the movable frame 2 swing upward and frontward. Finally, with the feet continuously treading the crank arms 15 to rotate in the same direction, the two crank arms 15 are caused to move from point D to return to point A (as shown in FIG. 8), causing the rocker arms to move back to the highest point and making the movable frame 2 further swing upward and frontward to get back to the original position. By repeating such a motion cycle, the movable frame 2 causes to move cyclically along a predetermined movement trace and generate a horse riding like motion, making the physical fitness device of the present invention totally different from the known fitness equipment.

Further, since the movable frame 2 are driven to swing frontward and rearward on the front and rear supports 11, 12 of the bottom rack 1, besides training of the muscles and joints and the stamina of legs and hips, the arms, abdomen, and chest of the user may also be trained by being stretched. Thus, effective training can be done on the muscles and joints of various portions of human body and result of exercise can be improved.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A horse-riding simulating physical fitness device, comprising:

a bottom rack, which includes a base having a front support and a rear support mounted thereon, the rear support having two side boards respectively and rotatably coupled to two crank arms that extend in the same direction, the two crank arms respectively having two rocker arms fixed thereto and located inside the two side boards of the rear support and extending in the same direction, wherein one of the crank arms is provided with a drive wheel outside the rear support for simultaneous rotation in unison therewith, the base having a wheel support mounted thereto, the wheel support rotatably supporting a flywheel, the drive wheel driving the flywheel to simultaneously rotate in unison therewith through a transmission assembly, the front support having an upper end rotatably coupled to a connection link; and a movable frame, which comprises a connection bar having opposite ends respectively coupled to the rocker arms of the bottom rack and the connection link, the connection bar having a seat bar that supports a seat cushion, the movable frame having a head bar, which carries a handlebar.

2. The horse-riding simulating physical fitness device according to claim 1, wherein the base of the bottom rack has an I-shape.

3. The horse-riding simulating physical fitness device according to claim 1, wherein the flywheel provides an adjustable damping resistance.

4. The horse-riding simulating physical fitness device according to claim 1, wherein the transmission assembly comprises a belt.

5. The horse-riding simulating physical fitness device according to claim 1, wherein the transmission assembly comprises a chain.

6. The horse-riding simulating physical fitness device according to claim 1, wherein the transmission assembly comprises mated gears.

7. The horse-riding simulating physical fitness device according to claim 1, wherein the crank arms of the bottom rack are set at a predetermined angle with respect to the rocker arms.

8. The horse-riding simulating physical fitness device according to claim 1, wherein the connection bar of the movable frame has an end comprising a first pivot coupled to the connection link of the bottom rack and an opposite end comprising a second pivot coupled to the rocker arms of the bottom rack.

* * * * *